US005150652A

United States Patent [19]

Yamamoto et al.

[11] Patent Number: 5,150,652

[45] Date of Patent: Sep. 29, 1992

[54] DEVICE FOR PUSHING PRINTING MATERIAL FOR USE IN A PRINTING APPARATUS

[75] Inventors: Hiroshi Yamamoto, Higashihiroshima; Mitsuhiro Hanato, Kouchi, both of Japan

[73] Assignees: Fuji Kikai Kogyo Kabushiki Kaisha, Hiroshima; Dainippon Ink and Chemicals, Inc., Tokyo, both of Japan

[21] Appl. No.: 846,314

[22] Filed: Mar. 5, 1992

[30] Foreign Application Priority Data

Mar. 11, 1991 [JP] Japan ..... 3-13448[U]

[51] Int. Cl.[5] ..... B41F 21/00

[52] U.S. Cl. ..... 101/232

[58] Field of Search ..... 101/232, 235, 272, 227, 101/233, 245, 407.1, 408, 409–412; 271/6, 7, 8.1, 198, 204, 264

[56] References Cited

U.S. PATENT DOCUMENTS 2,787,214 4/1957 Halahan ..... 101/232

4,524,691 6/1985 Miller ..... 101/232

*Primary Examiner*—J. Reed Fisher

*Attorney, Agent, or Firm*—Jordan and Hamburg

[57] ABSTRACT

A pushing device is provided with an impression cylinder, sheet pusher for pushing a rear end of printing sheet, drive chain for driving the sheet pusher, and drive transmission mechanism for transmitting the driving force used to rotate the impression cylinder to the drive chain. The drive transmission mechanism includes a clutch which engages and disengages to permit and prohibit a transmission state of the drive transmission mechanism, clutch actuator for actuating the clutch in accordance with a signal from a control unit, and drive device for rotating a drive shaft for the drive chain. Accordingly, the position of the sheet pusher can be adjusted easily and properly according to a change in the size of the printing sheet, and a leading end of the printing sheet can be accurately positioned relative of holders provided on the impression cylinder.

6 Claims, 7 Drawing Sheets

59
66
64
60
57
62
61
63
58
56
63
62
61

DEVICE FOR PUSHING PRINTING MATERIAL FOR USE IN A PRINTING APPARATUS

BACKGROUND OF THE INVENTION AND RELATED ART STATEMENT

This invention relates to a device for pushing printing sheet toward a printing assembly for use in a printing apparatus in which printing is applied to material made of metal sheet material such as aluminum plate and tin plate.

It has been a usual practice that material to be printed in the form of sheet (hereinafter referred to as printing sheet) has conventionally been transported between a blanket cylinder 55 and an impression cylinder 56 by a pusher means 57 in a general printing apparatus as shown in FIG. 5. The printing apparatus is provided with a container 51 for containing therein printing sheets, transport assembly 52 for transporting printing sheets dispensed one by one from the container 51, and printing assembly 53 includes a plate cylinder 54 for applying printing to the printing sheet transported thereto, blanket cylinder 55 and impression cylinder 56. The pusher means 57 is, as shown in FIGS. 6 and 7 illustrating an existing pushing device, provided with a pair of sprockets 61, chains 62, and sheet pushers 63. The pair of sprockets 61 are secured to the drive shaft 58 with spaced away from each other, and the chain 62 is wounded on each sprocket 61. The sheet pusher 63, mounted to the chain 62, pushes a rear end of the printing sheet to give additional force in transporting the printing sheet.

At one end of the drive shaft 58 are provided a clutch 64 which engages and disengages to permit and prohibit a transmission state of a drive transmission mechanism 60, coupling bolt 65 for holding the clutch 64 in its engaged state, and operation handle 66 for operably rotating the drive shaft 58. The drive transmission mechanism 60 includes a plurality of gears arranged so as to transmit the driving force of drive means 59 for drivingly rotating the impression cylinder 56 to the drive shaft 58. In such a case where the size of the printing sheet to be transported is charged, the coupling bolt 65 is unfastened to cause the clutch 64 to disengage, whereby to disconnect the impression cylinder 56 and drive shaft 58 from each other. Then, the drive means 59 causes the impression cylinder 56 to rotate so as to set at a reference position holders provided on a circumferential surface of the cylinder 56 for holding the printing sheet while an operating state of the drive means 59 is being detected by a rotary encoder 67. In addition, the drive shaft 58 is rotated by operating the operation handle 66 to adjust positions of the sheet pushers 63, so that a leading end of the printing sheet is positioned at the reference position. Thereby, the leading end of the printing sheet is held by the holders at an appropriate timing.

With the pushing device thus constructed, each time the size of printing sheet is to be changed, positions of the sheet pushers have to manually adjusted by rotating the operation handle, or other ways. This manual adjustment is very cumbersome. Further, in the case where a torque releaser mounted on the drive shaft operates to cause the position of the holders of the impression cylinder relative to that of the sheet pushers to change at an occurrence of jamming of the printing sheet, the above cumbersome adjustment has to be made.

It is an object of the print invention to provide a device for pushing printing material for use in a printing apparatus which has overcome the above drawbacks.

SUMMARY OF THE INVENTION

Accordingly, the present invention is directed to a device for pushing printing sheet for use in a printing apparatus comprises an impression cylinder for applying a specified printing to printing material, first drive means for driving the impression cylinder, pusher means for feeding the printing material to the impression cylinder, a drive shaft for driving the pusher means, drive transmission means for transmitting drive force from the first drive means to the drive shaft, first clutch means which engages and disengages to permit and prohibit transmission of driving force from the first drive means to the drive shaft, actuating means for actuating the first clutch to engage and disengage, second drive means for drivingly rotating the drive shaft, second clutch means which engages and disengages to permit and prohibit transmission of driving force from the second drive means to the drive shaft, control means for controlling the second clutch means to engage and disengage, and operation means for operating the control means.

It is preferable that the first clutch means be so constructed as to drive the pusher means mechanically. The pushing may further comprise drive chain means driven by the drive means and the pusher means is mounted to the drive chain means. Furthermore, the drive transmission means may includes a plurality of gears engageable with one another to transmit the driving force from the first drive means.

With the pushing device thus constructed, the first clutch is brought into the disengaged state by way of the control means and actuating means merely by operating the operation means, thereby prohibiting transmission of the driving force used to rate the impression cylinder to the pusher means. In addition, upon engagement of the second clutch means, the pusher means are driven by the driving force from the second drive means independently of the impression cylinder to set the position of the pusher means properly. Accordingly, the position of the pusher means can be adjusted rapidly and accurately.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
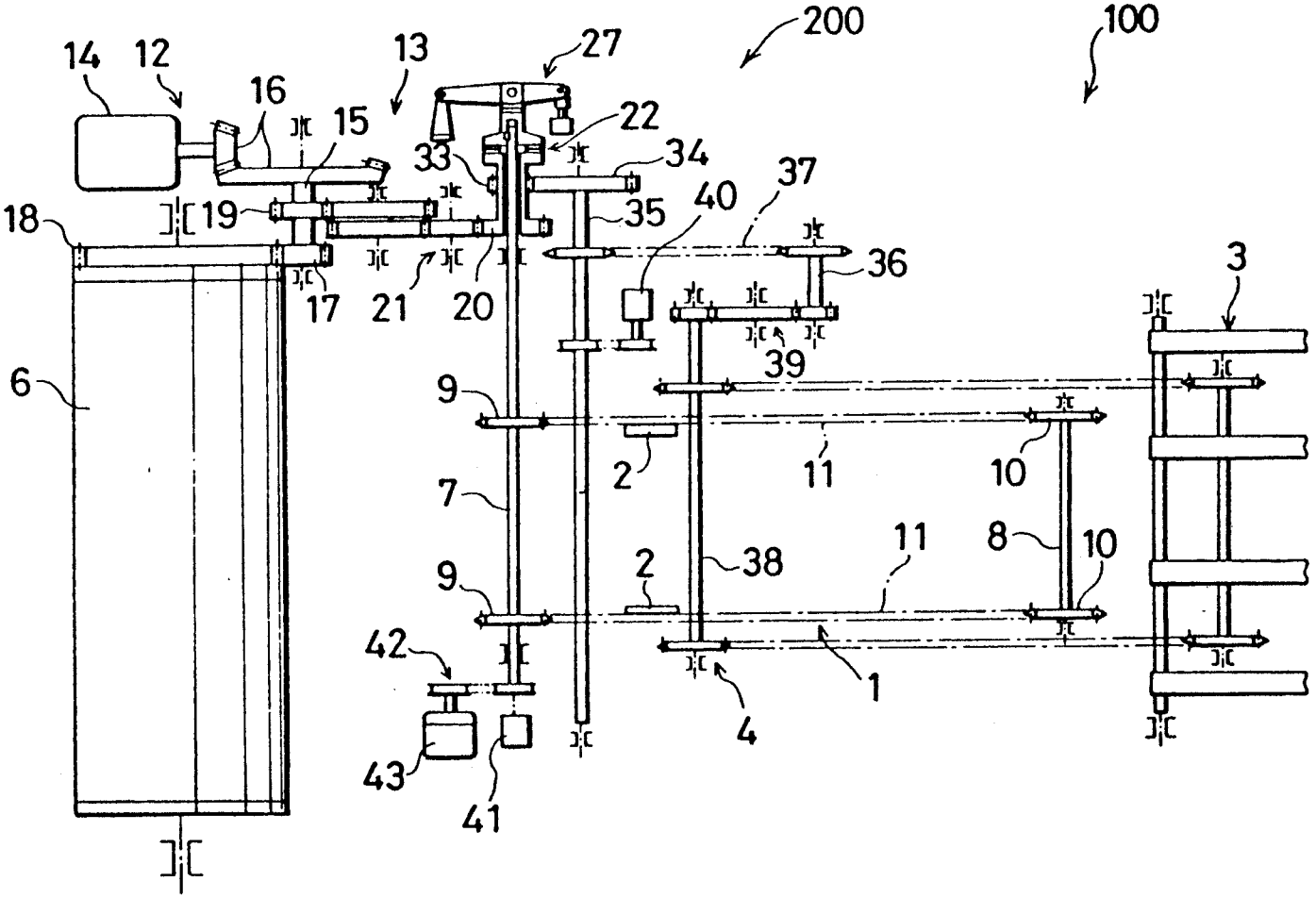
FIG. 1 is a schematic plan view showing a pushing device embodying the invention.
Figure 2:
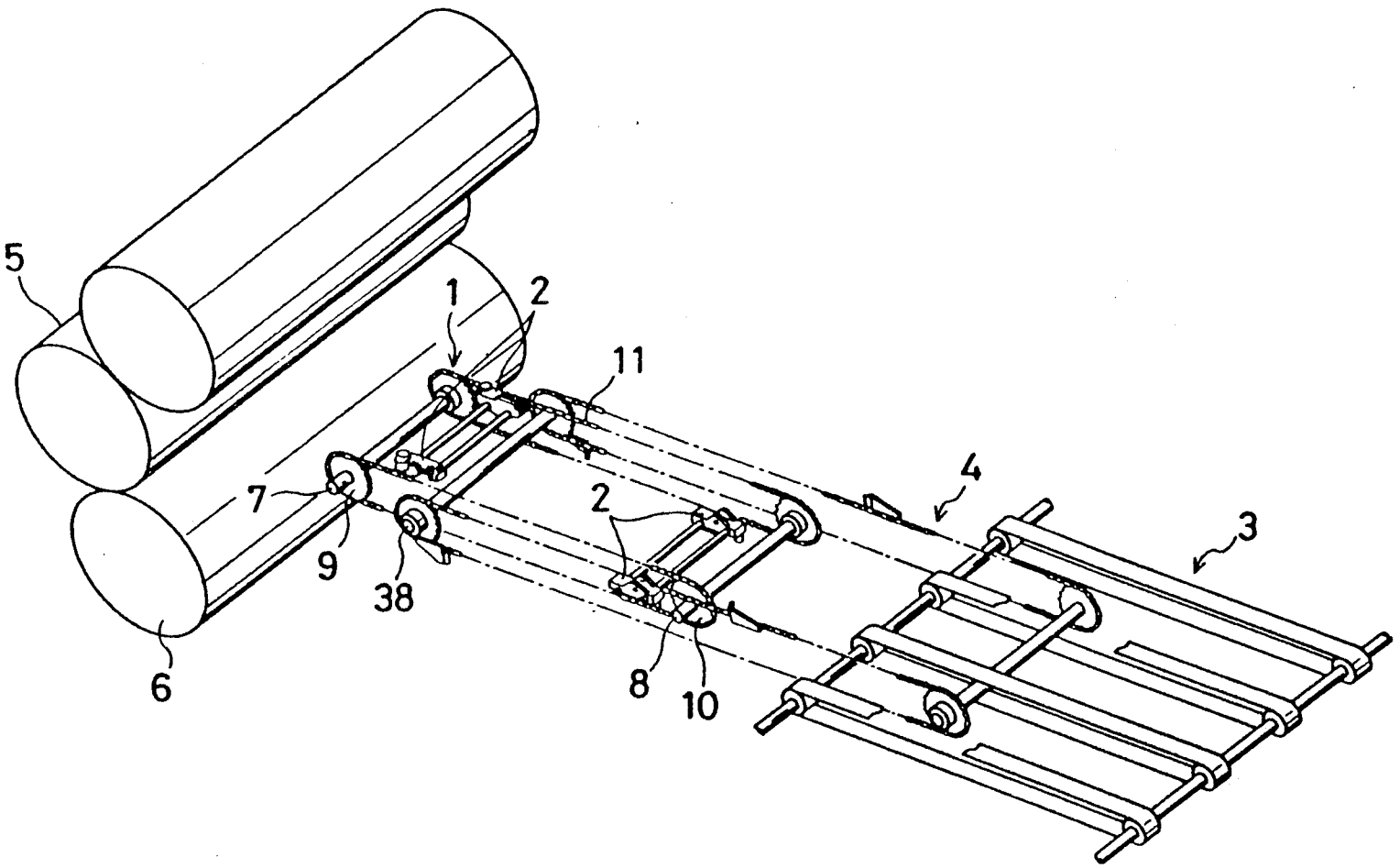
FIG. 2 is a perspectively view showing a construction of the pushing device.

FIGS. 1 and 2 show a transport assembly provided in a printing apparatus having a pushing device 100 embodying the invention. The transport assembly has first transport means 3 including belt conveyors, second transport means 4 including chain conveyors, and pusher means 1 including chain conveyors having sheet pushers 2 mounted thereto. The first transport means 3 is disposed upstream (forward) of the second transport means 4 with respect to a direction of transport of printing material. Printing material in the form of sheet is transported by the first and second transport means 3, 4 and is fed between a blanket cylinder 5 and an impression cylinder 6 provided in an printing assembly.

The pusher means 1 has a first shaft (pusher drive shaft) rotatably supported to an unillustrated apparatus frame for driving the sheet pushers 2, two pairs of sprockets 9, 10 fixed to the shafts 7, 8 respectively, a pair of drive chains 11. Each of the drive chains 11 is wound between the sprocket 9 and its corresponding sprocket 10 and has a pair of sheet pushers 2 disposed in different positions. A pushing device 100 includes the pusher means 1, first and second transport means 3, 4, first drive means 12, drive transmission mechanism 13, clutch mechanism 200, second drive means 43, and the like. The drive transmission mechanism 13 includes a plurality of gears arranged so as to transmit the driving force of first drive means 12 to the first shaft 7. When the first shaft 7 is drivingly rotated upon receipt of the driving force from the first drive means 12, the drive chains 11 and sheet pushers 2 move in the transport direction of printing sheet, whereby pushing a rear end of a printing sheet being transported to give additional force thereto.

The first drive means 12 is provided with a drive motor 14 disposed on one side of the impression cylinder 6, intermediate shaft 15 arranged in parallel to the impression cylinder 6, bevel gear mechanism 16 for transmitting the driving force of the drive motor 14 to the intermediate shaft 15, intermediate gear 17 secured to the intermediate shaft 15, and impression gear 18 secured to one end of the impression cylinder 6. The first drive means 12 is so constructed that the driving force of the drive motor 14 is transmitted to the impression gear 18 by way of the intermediate shaft 15, whereby to drivingly rotate the cylinder 6 together with the gear 18.

The drive transmission mechanism 13 is provided with a drive gear 19 secured to the intermediate shaft 15, driven gear 20 rotatably and externally fitted to the first shaft 7, intermediate gears 21 provided between the drive gear 19 and drive gear 20, and a clutch (first clutch) 22 disposed at one end of the first shaft 7. The torque of the intermediate shaft 15 is transmitted to the driven gear 20 by way of the drive gear 19 and intermediate gears 21. Then, the torque of the driven gear 20 is transmitted to the first shaft 7 by way of the clutch 22, and thereby the drive chains 11 and sheet pushers 2 driven at a speed corresponding to a rotating speed of the impression cylinder 6.

The clutch means 200 is provided with the clutch 22 and clutch actuator 27. The clutch 22 includes a clutch hub 24 integrally coupled to the one end of the first shaft 7 with a key 23, clutch drum 26 secured to an upper end of the driven gear 20 in the drawing of FIG. 3, and coupling portion 75 for detachably coupling the clutch hub 24 with clutch drum 26. The coupling portion 75 includes a plurality of first clutch plates provided on an outer circumferential surface of the clutch hub 24 projecting outward thereof and a plurality of second clutch plates provided on an inner circumferential surface of the clutch drum 26. The plurality of first and second clutch plates are engageably and disengageably interlaminated. When the first and second clutch plates are compressingly engaged with one another, the clutch 22 is brought into an engaged state, and thereby the clutch hub 24 and clutch drum 26 are rotated together. As a result, the torque from the drive motor 14 is transmitted to the first shaft 7. On the other hand, when the first and second clutch plates are disengaged from one another, the clutch 22 is brought into a disengaged state, and thereby the clutch hub 24 and clutch drum 26 are rotated independently of each other.

Figure 3:
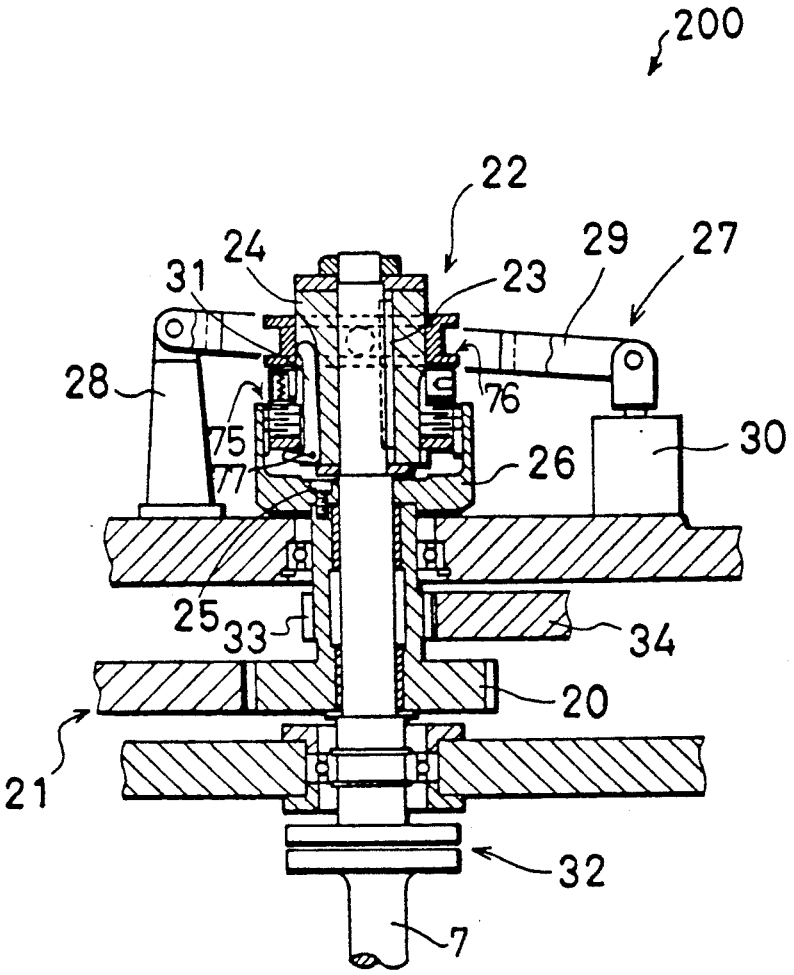
FIG. 3 is a sectional view showing a construction of a clutch mechanism for the pushing device.

The clutch actuator 27 has a support bracket 28, clutch lever 29 pivotally supported to the support bracket 28 at a leading end thereof, drive cylinder 30, slide ring 76, and L-shaped arm 31. A base end of the clutch lever 29 is connected to the drive cylinder 30. The drive cylinder 30 expands and contracts with air pressure to move upward and downward the base end of the clutch lever 29. The slide ring 76 is externally fitted to the clutch hub 24 and slidable along the hub 24 in a vertical direction in the drawing of FIG. 3, and is connected to a middle portion of the clutch lever 29. The arm 31 is mounted to the clutch hub 24 with a pin 77 at a lower end thereof, and is pivotably about the pin 77. Further, the slide ring 76 is pressed upward by a spring disposed herebelow, and is normally positioned above an upper end of the arm 31 when the clutch 22 is in the disengaged state. When the slide ring 76 is lowered against the elasticity of the spring from the above position, an upper end portion of the arm 31 is fitted inside the slide ring 76 as shown in FIG. 3. The upper end portion of the arm 31 is pushed inward by an inner circumferential surface of the ring 76, whereby the arm 31 rotates clockwise about the pin 77 to push the coupling portion 75 upward with a lower projecting portion thereof. In this way, the first and second clutch plates are compressingly engaged with one another and the clutch 22 is brought into the engaged state. The clutch 22 are brought into the engaged state and disengaged state by operating the drive cylinder 30 to pivot the clutch lever 29 in accordance with a signal sent from an operation unit 44 to be described later.

The first shaft 7 is provided with a torque releaser 32 for releasing a drive transmission state in the event of jamming of the printing sheet, and a drive gear 33 constituting in part driving mechanism for driving the second transport means 4 is mounted to a boss of the driven gear 20. As shown in FIG. 1, the driving mechanism of the second transport means 4 includes a driven gear 34 drivingly rotated by the drive gear 33, rotatable shaft 35 which rotates together with the driven gear 34, intermediate shaft 36, chain mechanism 37 for transmitting the torque of the rotatable shaft 35 to the intermediate shaft 36, and intermediate gears 39 for transmitting the torque of the intermediate shaft 36 to the drive shaft 38 of the second transport means 4. The rotatable shaft 35 is so constructed that a rotating state thereof is detected by a rotary encoder 40.

Figure 4:
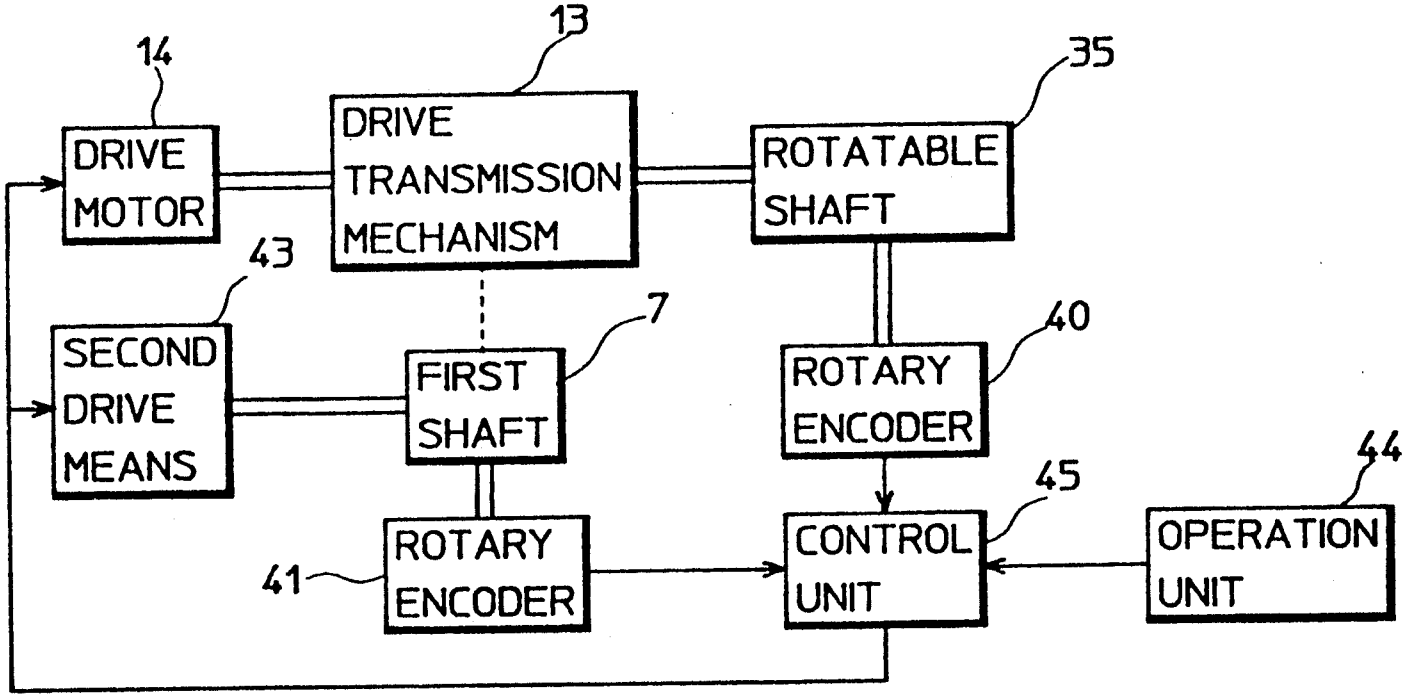
FIG. 4 is a block diagram showing a construction of a control circuit provided in drive means.
Figure 5:
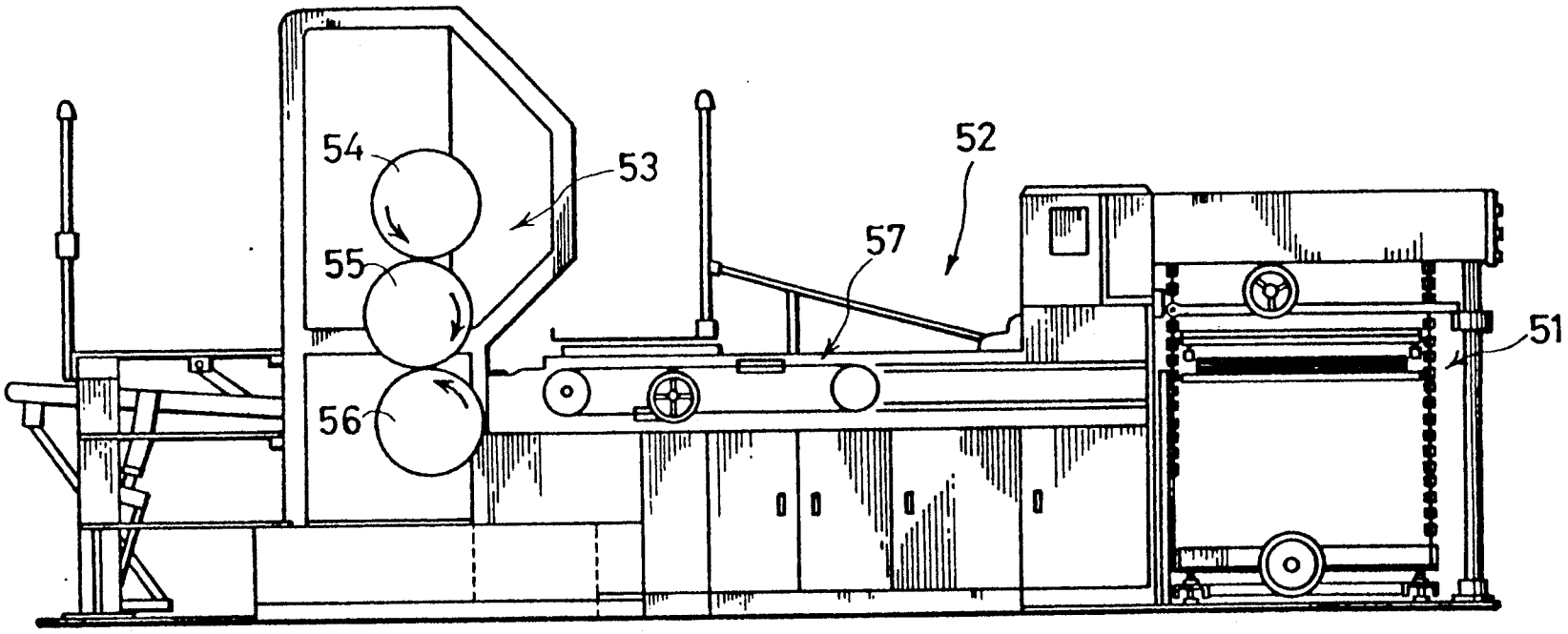
FIG. 5 is a schematic front view showing an entire construction of a general printing apparatus.
Figure 6:
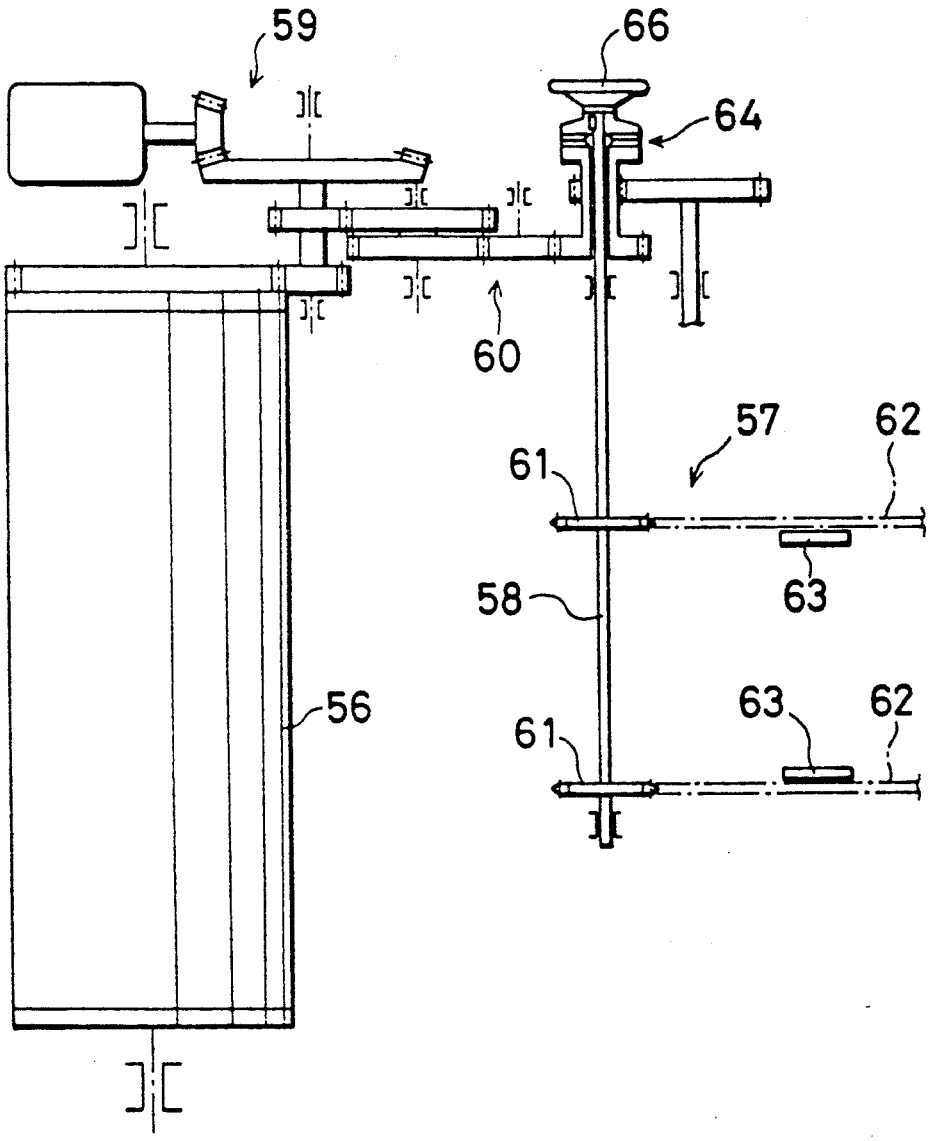
FIG. 6, similar to FIG. 1, is a schematic plan view showing a pushing device of prior art.
Figure 7:
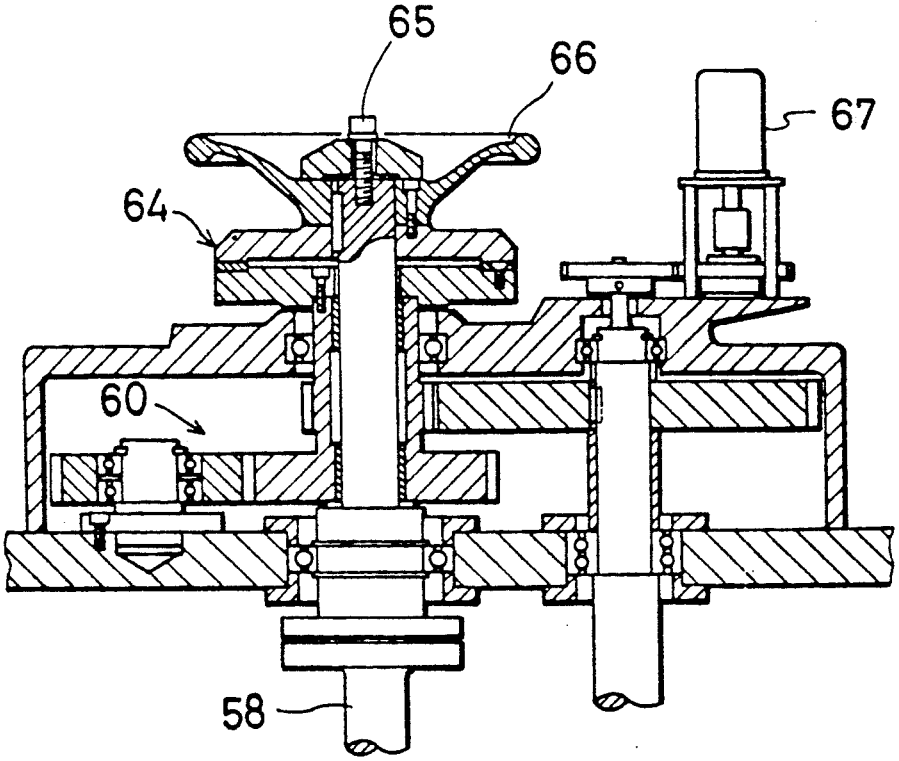
PRIOR ART FIG. 7
FIG. 7, similar to FIG. 3, is a sectional view showing a construction of a clutch mechanism for the pushing device of prior art.

At the other end of the first shaft 7 of the pusher means 1 is provided a rotary encoder 41 for detecting a rotating state of the first shaft 7 and second drive means 43 including a drive motor for transmitting the torque to the first shaft 7 by way of a clutch (second clutch) and timing belt mechanism 42. As shown in FIG. 4, sensor signals from the rotary encoders 40, 41 and signals from an operation unit 44 including operation switches are input is a control unit 45, which in turn sends control signals corresponding to the received signals to the drive motor 14 and second drive means 43. Upon receipt of the control signals, the drive motor 14 and second drive means 43 drive the pusher means 1 and second transport means 4 respectively. In this way, the control unit 45 controls the driving of the pusher means 1 and the second transport means 4.

With the above construction, when the operation unit 44 shown in FIG. 4 is operated to bring the clutch of the second drive means 43 shown in FIG. 1 into the engaged state by way of the control unit 45, the second drive means 43 is connected to the first shaft 7 by way of the timing belt mechanism 42. Simultaneously, the drive cylinder 30 is driven to bring the clutch 22 into the disengaged state so as to prevent the torque from the first drive means 12 from being transmitted to the first shaft 7. The first shaft 7 is rotated by driving the second drive means 43 to set the sheet pushers 2 at a reference position. The reference position is a position where the sheet pushers 2 wait for the printing sheet transported by the first and second transport means 3, 4. Positioning of the sheet pushers 2 are performed by, for example, operating a pusher positioning button provided in the operation unit 44. The control unit 45 executes a feedback control so as to drive the second drive means 43 by a required amount in accordance with a pusher positioning signal sent from the operation unit 44. Specifically, the rotary encoder 41 detects an actual rotation amount of the first shaft 7, and sends the detection result to the control unit 45. The control unit 45 causes the first shaft 7 to rotate a specified amount necessary to set the sheet pushers 2 at the reference position based on the received detection result.

Further, holders provided on the impression cylinder 6 for holding a leading end of the printing sheet are positioned as follows. The operation unit 44 is operated to bring the clutch 22 into the disengaged state and the drive motor 14 is driven to rotate the impression cylinder 6 to set the holders at a reference position. The positioning of the holders is also conducted by using the operation unit 44 similarly to the positioning of the sheet pushers 2. The control unit 45 executes a feedback control using an actual rotation amount of the impression cylinder 6 measured by the rotary encoder 40.

Upon completion of adjustment of the holders of the impression cylinder 6 and sheet pushers 2, the clutch of the second drive means 43 disengages. In addition, the clutch 22 engages to start the transmission of the torque from the drive motor 14, whereby starting the operation of the printing apparatus. Upon engagement of the clutch 22, the torque from the drive motor 14 is transmitted to the drive shaft 38 by way of the intermediate shaft 15, intermediate gears 21, drive gear 33, driven gear 34, chain mechanism 37, intermediate shaft 36, intermediate gears 39 in this order, whereupon the first and second transport means 3, 4 are driven. Further, the torque from the drive motor 14 is transmitted to the first shaft 7 by way of intermediate gears 21 and clutch 22, whereupon the pusher means 1 is driven. Simultaneously, the torque from the drive motor 14 is transmitted to the impression cylinder 6 by way of the intermediate shaft 15, intermediate gear 17, and impression gear 18, whereupon the impression cylinder 6 is rotated together with the pusher means 1, first and second transport means 3, 4.

Each of the printing sheets dispensed one by one from a container and fed to the transport assembly is transported to a specified position in the pusher means 1 by the first and second transport means 3, 4. Then, the printing sheet is transported to the printing assembly while having a rear end thereof pushed by the sheet pushers 2 mounted to the drive chains 11. The printing sheet is fed between the blanket cylinder 5 and impression cylinder 6 with the leading end thereof held by the holders provided on the circumferential surface of the cylinder 6, whereupon printing is applied thereto. Consequently, the printing sheet is discharged.

In the case where the size of the printing sheet to be fed to the printing assembly is changed or some trouble occurs such as jamming of the printing sheet, the leading end of the printing sheet becomes dislocated relative to the impression cylinder 6. An occurrence of trouble is detected by an unillustrated detector which sends a detection signal to the control unit 45. Upon receipt of this signal, the control unit 45 stops the driving of the drive motor 14.

After removing the cause of the trouble, the holders of the impression cylinder 6 and pusher means 1 are set at respective reference positions in the same manner as initially set.

As described above, the pushing device is provided with the control unit 45, clutch 22 drivingly controlled by the control unit 45, and clutch actuator 27. The pushing device is so constructed that the clutch 22 is brought into the engaged state and disengaged state through the control unit 45 by operating the operation unit 44 and that the impression cylinder 6 and pusher means 1 are automatically set at the respective reference positions. Accordingly, unlike the existing pushing devices, the pushing device of the invention requires no such cumbersome manual operation as to rotate the operation handle after bringing the clutch into the disengaged state, thereby enabling the positioning of the sheet pushers 2 to be performed rapidly and accurately. Therefore, it can be effectively prevented that the printing sheet is fed to the printing assembly at an improper timing in such a case where the size of the printing sheet is changed.

When an electric clutch is used, the clutch disengages in the event of power outage or the like during the operation of the printing apparatus, whereby causing dislocation of the printing sheet relative to the impression cylinder 6. However, being of the mechanical type, the clutch 22 is not subject to the above problems.

Further, in the foregoing embodiment, the rotary encoders 40, 41 are provided to detect rotating states of the rotatable shaft 35 and first shaft 7 and to second the sensor signals to the control unit 45. The control unit 45 executes a feed-back control based on the detected rotating states so as to correspond the operating states of the first and second drive means 12, 43 with the value inputted through the operation unit 44. Accordingly, the pushing device of the invention has an advantage that the positions of the sheet pushers 2 can be adjusted with more accuracy.

As described above, in accordance with the invention, a clutch is provided in a drive transmission mechanism for transmitting the driving force from first drive means for rotating an impression cylinder to a drive shaft of pusher means so as to permit and prohibit the drive transmission to the drive shaft; an actuator for actuating the clutch is controlled with the use of an operation unit by way of a control unit; second drive means for driving the pusher means is provided independently of the first drive means; whereby the pusher means and impression cylinder are controlled independently by the control unit. Accordingly, unlike the existing pushing devices, the pushing device of the invention requires no such cumbersome manual operation as to rotate the operation handle after bringing the clutch into the disengaged state, thereby enabling the positioning of the sheet pushers to be performed rapidly and accurately by merely operating the operation unit. Therefore, dislocation of a leading end of printing material relative to the impression cylinder can be adjusted without stopping a printing apparatus for a long time in the case where the size of the printing material is changed or some trouble occurs such as jamming of the printing material.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be constructed as being included therein.

What is claimed is:

1. A device for pushing printing material for use in a printing apparatus comprising:

an impression cylinder for applying a specified printing to printing material;

first drive means for driving the impression cylinder;

pusher means for feeding the print material to the impression cylinder;

a drive shaft for driving the pusher means;

drive transmission means for transmitting driving force from the first drive means to the drive shaft;

first clutch means which engages and disengages to permit and prohibit transmission of driving force from the first drive means to the drive shaft;

actuating means for actuating the first clutch to engage and disengage;

second drive means for rotating the drive shaft;

second clutch means which engages and disengages to permit and prohibit transmission of driving force from the second drive means to the drive shaft;

control means for controlling the second clutch means to engage and disengage; and operation means for operating the control means.

2. A device as defined in claim 1 wherein the first clutch means is so constructed a to drive the pusher means mechanically.

3. A device as defined in claim 1 further comprising drive chain means driven by the drive means wherein the pusher means is mounted to the drive chain means.

4. A device as defined in claim 1 wherein the drive transmission means includes a plurality of gears engageable with one another to transmit the driving force from the first drive means to the drive shaft.

5. A device as defined in claim 2 wherein the drive transmission means includes a plurality of gears engageable without one another to transmit the driving force from the first drive means to the drive shaft.

6. A device as defined in claim 3 wherein the drive transmission means includes a plurality of gear engageable with one another to transmit the driving force from the first drive means to the drive shaft.

* * * * *